US008382320B2

(12) United States Patent
Kuegler

(10) Patent No.: US 8,382,320 B2
(45) Date of Patent: Feb. 26, 2013

(54) POLYHEDRALLY-SHAPED HEAT DISSIPATING LED SUPPORT

(76) Inventor: Christoph Kuegler, Munich (DE)

( * ) Notice: Subject to any disclaimer, the term of this patent is extended or adjusted under 35 U.S.C. 154(b) by 558 days.

(21) Appl. No.: 12/519,427

(22) PCT Filed: Dec. 21, 2007

(86) PCT No.: PCT/EP2007/011381

§ 371 (c)(1),
(2), (4) Date: Jan. 11, 2010

(87) PCT Pub. No.: WO2008/077627

PCT Pub. Date: Jul. 3, 2008

(65) Prior Publication Data

US 2011/0038152 A1 Feb. 17, 2011

(30) Foreign Application Priority Data

Dec. 22, 2006 (DE) ..... 10 2006 061 020

(51) Int. Cl.
*F21S 4/00* (2006.01)
*F21V 29/00* (2006.01)

(52) U.S. Cl. ..... 362/249.02; 362/547; 362/294; 362/373

(58) Field of Classification Search ..... 362/612, 362/555, 580, 547, 218, 249.02, 294, 373, 362/800; 257/88, 99
See application file for complete search history.

(56) References Cited

U.S. PATENT DOCUMENTS 5,237,490 A * 8/1993 Ferng ..... 362/183
6,299,337 B1 10/2001 Bachl et al.
6,688,752 B2 * 2/2004 Moore ..... 362/234
6,991,351 B1 * 1/2006 Petrick ..... 362/373
7,285,903 B2 * 10/2007 Cull et al. ..... 313/500
7,401,945 B2 * 7/2008 Zhang ..... 362/249.01
7,434,964 B1 * 10/2008 Zheng et al. ..... 362/294
2004/0114367 A1 * 6/2004 Li ..... 362/248
2006/0214179 A1 * 9/2006 Cao ..... 257/99
2006/0256557 A1 * 11/2006 Kanamori et al. ..... 362/249
2007/0230172 A1 * 10/2007 Wang ..... 362/249
2007/0230184 A1 * 10/2007 Shuy ..... 362/294
2009/0109674 A1 * 4/2009 Lodhie ..... 362/249.02
2009/0316408 A1 * 12/2009 Villard ..... 362/249.13

FOREIGN PATENT DOCUMENTS

DE 20008944 U1 11/2000
DE 20013605 U1 2/2001
DE 20207745 U1 9/2002
DE 102004004947 A1 8/2005
EP 1033525 A2 9/2000
EP 1298383 A2 4/2003
EP 1510754 A2 3/2005

OTHER PUBLICATIONS

International Search Report for PCT/EP2007/011381 published Apr. 18, 2008.

* cited by examiner

*Primary Examiner* — Ismael Negron

(74) *Attorney, Agent, or Firm* — Choate, Hall & Stewart LLP; Andrea L. C. Robidoux; Daniel S. Matthews

(57) ABSTRACT

An LED-illuminant includes a plurality of LED arranged on a corresponding plurality of supports each support having an angled support section. The angled support sections being adjacent to one another to form angled surfaces of a polyhedron. The heat of each LED is respectively dissipated from the angled support section to the rest of the support.

23 Claims, 5 Drawing Sheets

POLYHEDRALLY-SHAPED HEAT DISSIPATING LED SUPPORT

Figure 1:
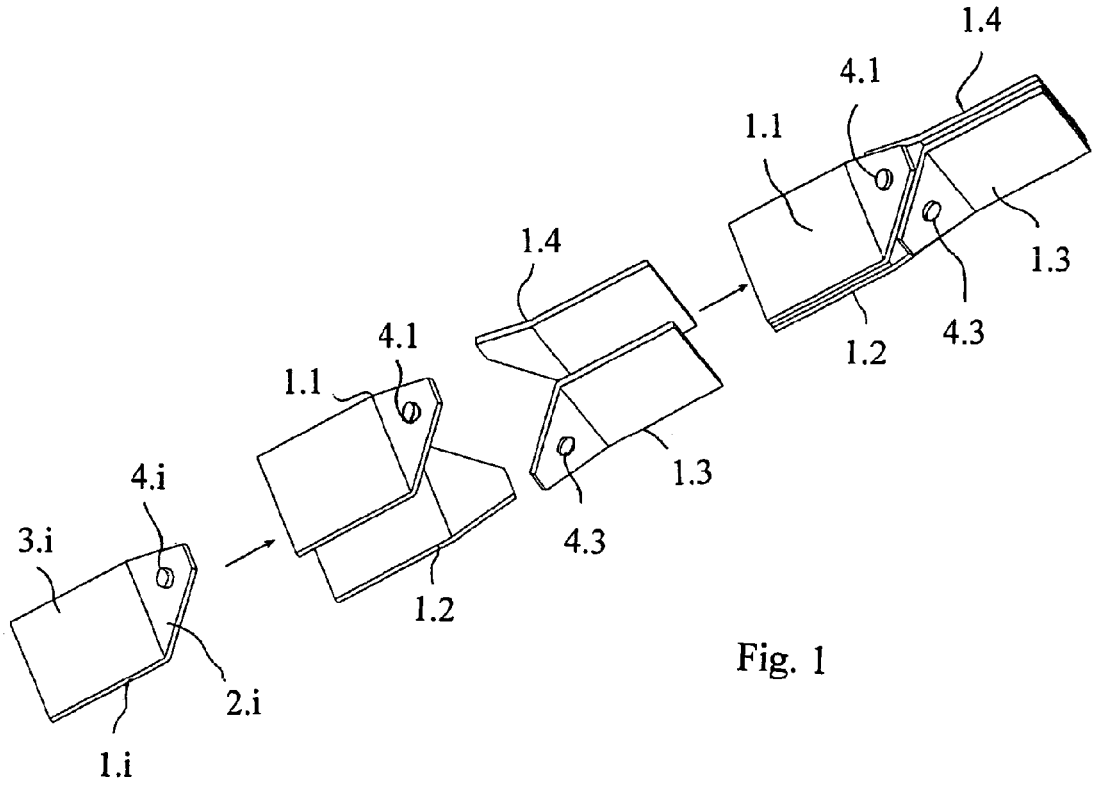

The invention relates to an LED-illuminant (LED—light emitting diode), a lamp comprising such an LED-illuminant as well as a method for fabrication of such an illuminant.

Illuminants are the light emitting items of a lamp. Examples for established illuminants are filament lamps (also referred to as filament bulbs), halide lamps or fluorescent lamps. Due to the progressive development in the field of LEDs also the LEDs as illuminants become increasingly interesting for applications, where at present mainly still filament lamps, halide lamps or fluorescent lamps prevail.

An LED is a semiconductor device based on a diode. If a forward current runs through the diode, it emits light. By the choice of the semiconductor material as well as the doping the wavelength of the emitted light can be influenced.

LEDs which generate white light (white LEDs) can be fabricated by covering a blue LED with a fluorescent dye. Alternatively, it is also possible to interconnect several light emitting diodes, which emit light in different colours, such that one yields white light due to the addition of colours. White LEDs are available as SMD-devices (surface mounted device), which can be directly soldered on an electrical circuit board by means of solderable connecting pads. Furthermore, white LEDs are obtainable also prefabricated on an electrical circuit board (for example on a square circuit board with the dimensions of 25×25 $mm^2$).

Important characteristics of an illuminant are its luminous efficiency in Lumens per Watt (Im/W) as well as its power consumption. Currently, available white LEDs typically exhibit a luminous efficiency of up to 50 Im/W as well as an absolute power consumption of 2.5 W per LED. The luminous efficiency of white LEDs is therefore higher than that of the filament and halide lamps (typical in the area of 10 Im/W to 20 Im/W), but lower than that of fluorescent lamps (up to 110 Im/W).

To replace a conventional illuminant like a filament lamp or a halide lamp, an LED-illuminant should deliver a comparable luminous flux. A comparable 75 W filament lamp for the high voltage operation (i.e. at a voltage supply of 230 V or 110 V) for example provides a luminous flux of about 900 Im. To achieve about half of the luminous flux of such a 75 W filament lamp with an LED-illuminant, for example four white LEDs with 50 Im/W and a power of 2.5' per LED may be interconnected, which results in a luminous flux of 500 Im.

Due to their structural shape LEDs have the disadvantage that individual LEDs only reach an angular range of emission of typically 120° to a maximum of 180° in contrast to filament lamps with an almost omni-directional characteristics of emission.

For the interconnection of several LEDs it must be assured that the lost heat of the LEDs is dissipated sufficiently, since otherwise the LEDs overheat and are destroyed.

From the document DE 200 13 605 U1 an elongated tubular light source is known which provides a plurality of SMD-LEDs as illuminant. Chains of SMD-LEDs are thereby mounted on the surface of a hollow body.

Further, from the document DE 10 2004 004 947 A1 an illuminant is known which provides the shape of a conventional filament lamp. For that purpose several LEDs are mounted on a cubical or octahedral shaped support within the interior of the illuminant. A disadvantage of such an assembly is that the support does not assure a sufficient dissipation of heat.

It is therefore object of the present invention to provide an LED-illuminant which provides an omni-directional emission characteristics as possible and a simultaneously sufficient dissipation of heat while providing a sufficiently high luminous flux.

It is further an object of the invention to provide a method of fabrication of such an illuminant.

The tasks underlying the invention are solved by the features of the independent claims.

The LED-illuminant according to the invention according to claim 1 comprises a plurality of supports, which advantageously are of similar type. The supports are respectively angled. Advantageously, the supports are angled metal sheets.

Further, the supports are arranged such that the angled support sections of the supports are adjacent, thus lying side by side. The solid angles of the surfaces of the angled support sections substantially correspond to different solid angles of a polyhedron. Thereby it can be provided that not only the solid angles correspond to that of a polyhedron but that also the angled support sections in shape and arrangement to each other correspond substantially to the sides of a polyhedron.

According to the invention, the LED-illuminant further provides a plurality of (advantageously white) LED-elements, for example white LED-SMDs, which are arranged on the angled support sections. Advantageously, at least one LED-element is arranged on each angled support section. The heat of the individual LED-elements is respectively dissipated starting from the angled support section via the rest of the support. An LED-element in the sense of the application can be not only a single LED but also an LED with associated circuit board.

Due to the arrangement of the LED-elements in different polyhedron-solid angles an omni-directional emission characteristics of the LED-illuminant can be achieved. Since angled supports are provided for the individual LED-elements, the heat of the individual LED-elements can be dissipated starting from the angled support section via the rest of the support in a sufficient manner. Due to the use of angled supports there is provided in this way for each LED-element not only the surface, on which the LED-element is arranged and which corresponds to the angled support section, but also a further cooling surface, which corresponds to the rest of the support. Thereby, the surface is significantly enlarged, which is available for the removal of heat.

It is pointed out that an angled support is not mandatory being created by bending an even original support. Rather, such a support can be achieved by assembling two support parts under an angle.

Further, the LED-illuminant is not mandatory fabricated by joining separated angled supports. It can, for example, be provided that initially the support sections on which the LED-elements are arranged or get aligned later, are first assembled, and that the angled support sections are mounted later.

Advantageously, for at least two supports, whose angled support sections are adjacent, the interior angle between the angled support section and the rest of the support corresponds to the half of the exterior angle between the adjacent angled support sections of said both supports. Thereby, the shading due to the rest of the support, which is used for the heat dissipation, can be minimized.

According to an advantageous embodiment two or more supports, in particular all supports, are arranged in parallel to a common axis. Thereby it is of advantage if a first group of supports extends in a first direction along the common axis, while a second group of supports extends in the opposite direction along the common axis.

It is of advantage, if the angled support sections substantially correspond to different side surfaces of a polyhedron or to parts of said side surfaces, such that adjacent support sections can be arranged such that they form a polyhedron.

Advantageously, the LED-illuminant provides at least four LED-elements. Even at an emission angle range of 120° per LED-element an almost omni-directional emission characteristics can be achieved this way.

The polyhedron can be a platonic body whose side surfaces are regular polygons, which are congruent to each other, and of which in each corner the same number respectively converge. Tetrahedron (4 faces), hexahedron (6 faces), octahedron (8 faces), dodecahedron (12 faces) and ikosahedron (20 faces) are respectively forming a platonic body.

Correspondingly, it can be advantageously provided that the polyhedron is a tetrahedron and the LED-illuminant comprises four angles support sections, wherein the solid angles of the four angled support sections substantially correspond to the four solid angles of the tetrahedron. In particular, the four angled support sections can correspond in form and arrangement to each other substantially to the faces of a tetrahedron. By arranging the angled support sections according to the solid angles of a tetrahedron, an almost omni-directional emission characteristics can be generated with already four LEDs.

If two or more supports are arranged along a common axis, it is of advantage if the supports form a channel along said axis, for example by bending of the support around the common axis. Thereby, the heat can be also dissipated via the interior sides of the support.

To further improve the heat dissipation, the supports can advantageously be mounted on a bar extrusion profile, for example, on an aluminium bar extrusion profile. In this case, the heat is dissipated via the thermally well conducting bar extrusion profile.

To increase the surface of the support it can be provided that the support provides holes. Due to the so-increased surface, the heat dissipation is further improved.

Advantageously, the LED-illuminant respectively comprises a socket. This should advantageously be a conventional illuminant socket for the high-voltage operation (typically 230 V or 110 V) or the low-voltage operation (typically 12 V). This allows the use of the LED-illuminant as substitute for current illuminants, for example, filament or halide lamps.

the supports are arranged such that the angled support sections are adjacent and the solid angles of the surfaces of the angled support sections correspond substantially to the different solid angles of a polyhedron.

Further advantageous embodiments of the invention are described in the subclaims.

Figure 2:
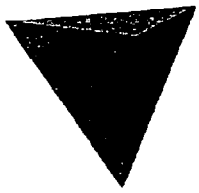
Figure 3:
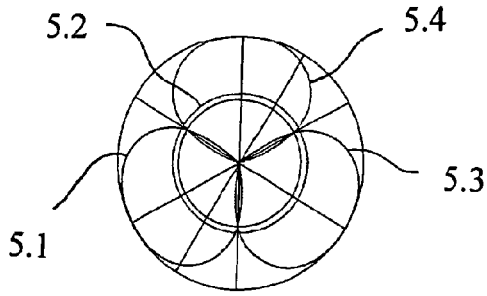
Figure 4:
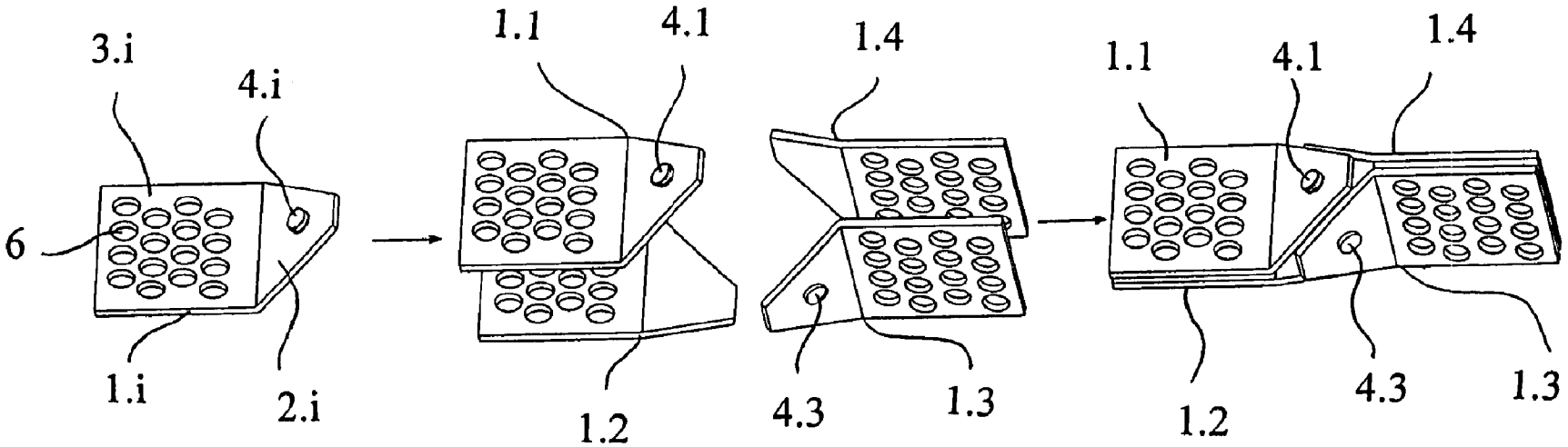
Figure 5:
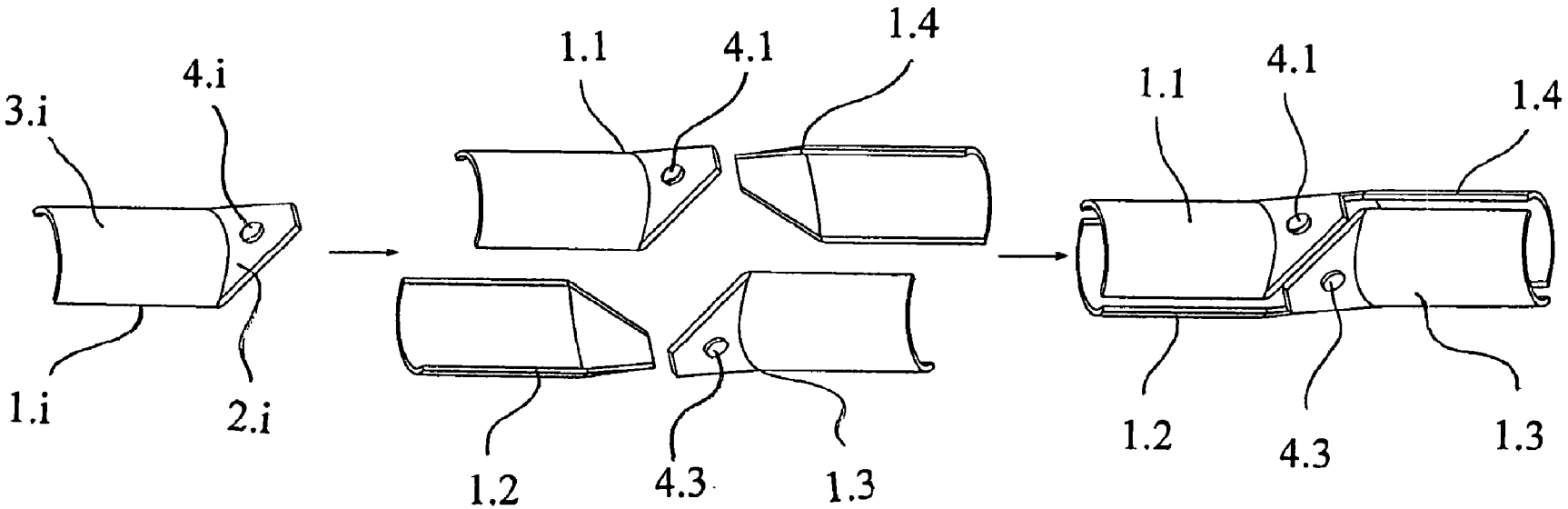
Figure 6:
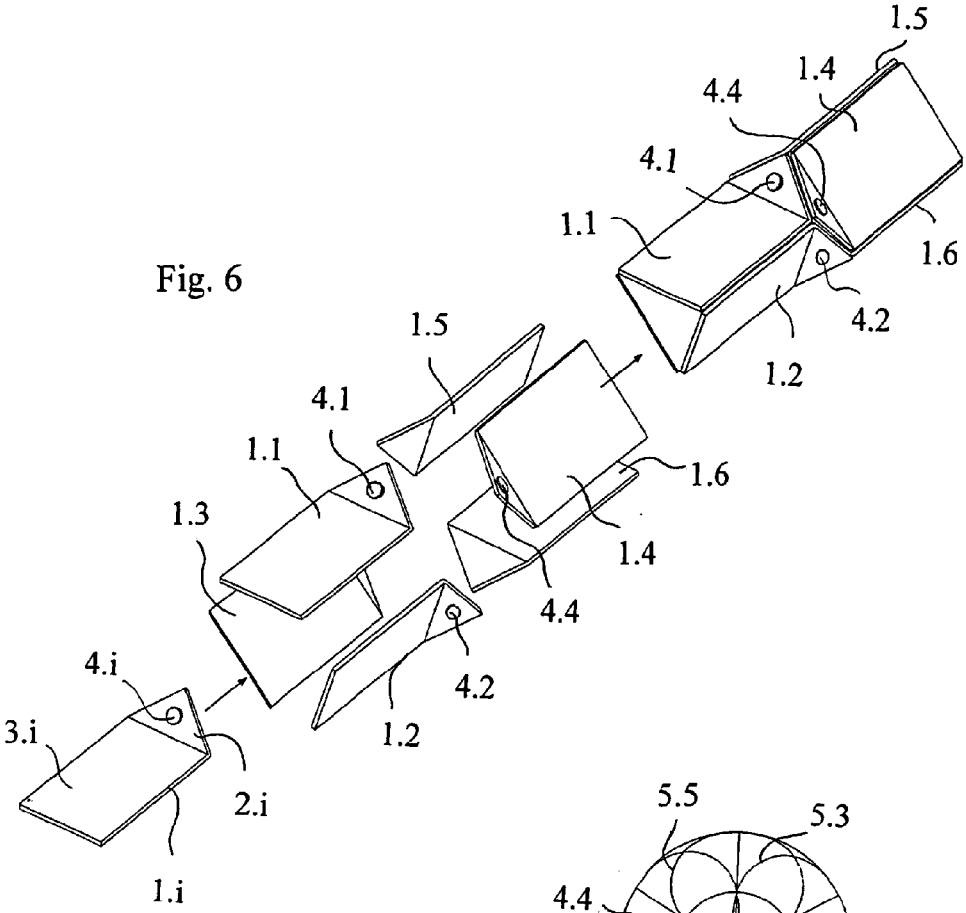
Figure 8:
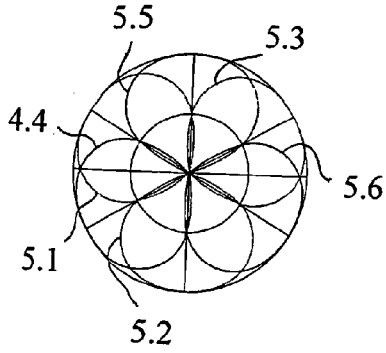
Figure 7:
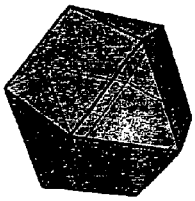

The invention is specified in the following with several exemplary embodiments and with reference to the drawings; therein is shown:

FIG. 1 a first exemplary embodiment of the LED-illuminant according to the invention with tetrahedron-shaped arrangement of the angled support sections;

FIG. 2 an ideal tetrahedron;

FIG. 3 a radiation diagram of the LED-illuminant shown in FIG. 1;

FIG. 4 a second exemplary embodiment of the LED-illuminant according to the invention with tetrahedron-shaped arrangement of the angled support sections and boring of the cooling metal sheets;

FIG. 5 a third exemplary embodiment of the LED-illuminant according to the invention with tetrahedron-shaped arrangement of the angled support sections with tubular shaped curve on cooling metal sheets;

FIG. 6 a fourth exemplary embodiment of the LED-illuminant according to the invention with six LEDs;

FIG. 7 an ideal cube-octahedron;

FIG. 8 a radiation diagram of the LED-illuminant shown in FIG. 6; and

Figure 9:
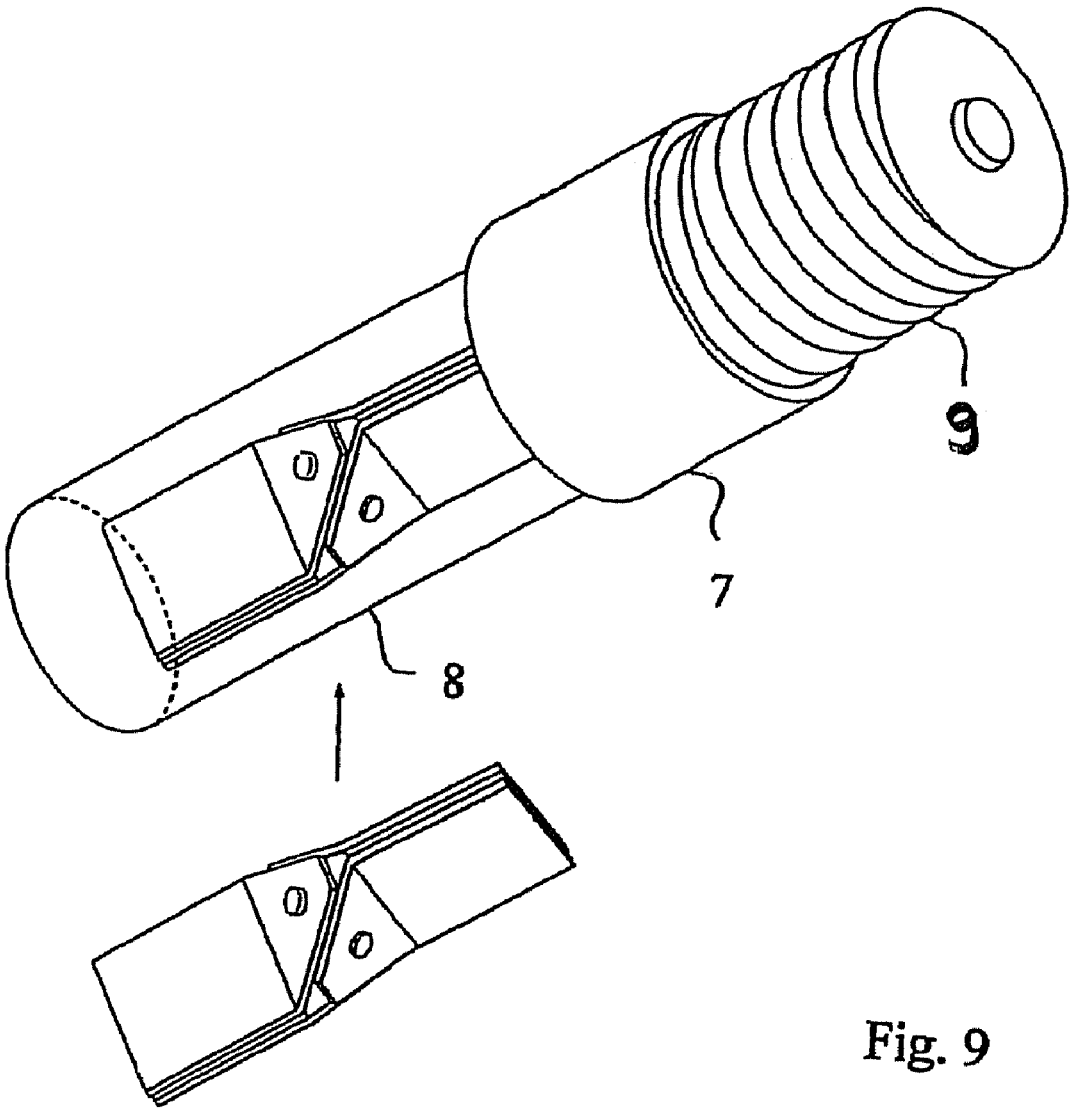

FIG. 9 an LED-illuminant with a socket, a transformer housing and an optional housing made of glass or plastic.

The following table shows the light efficiency and the total power loss of a white LED-illuminant with the light colour warm-white (about 3,500 K) in dependence on the number of the white LEDs used and the LED characteristics (power per LED in Watt as well as light efficiency in lumen per Watt). A low luminous flux hereby lies in the range of 500 lm to 750 lm, a high luminous flux follows starting from 1,000 lm. Furthermore, it has to be assumed that the illuminant becomes very hot at a total power loss starting from 30 W. At a total power loss of over 40 W the illuminant becomes so hot that it is destroyed.

| Power | 50 lm/W | | | 70 lm/W | | 100 lm/W | |
|---|---|---|---|---|---|---|---|
| per LED | 4 LEDs | 6 LEDs | 8 LEDs | 4 LEDs | 6 LEDs | 4 LEDs | 6 LEDs |
| 2.5 W | 500 lm (10 W) | 750 lm (15 W) | 1,000 lm (20 W) | 700 lm (10 W) | 1,050 lm (15 W) | 1,000 lm (10 W) | 1,500 lm (15 W) |
| 5 W | 1,000 lm (20 W) | 1,500 lm (30 W) | 2,000 lm (40 W) | 1,400 lm (20 W) | 2,100 lm (30 W) | 2,000 lm (20 W) | 3,000 lm (30 W) |
| 10 W | 2,000 lm (40 W) | 3,000 lm (60 W) | 4,000 lm (80 W) | 2,800 lm (40 W) | 4,200 lm (60 W) | 4,000 lm (40 W) | 6,000 lm (60 W) |

Further, there is advantageously provided an electronic ballast (transformer) in the LED-illuminant.

The lamp according to the invention of claim 21 comprises an LED-illuminant as described before.

The method according to the invention for fabricating an LED-illuminant comprises according to claim 23 a plurality of steps. In a first step, a plurality of angled supports is provided. On the angled support sections a plurality of LED-elements are respectively arranged, wherein during the operation of the LED-illuminant the heat of the individual LED-elements is respectively dissipated starting from the angled support sections via the rest of the support. In a further step, White LEDs with a power loss of 2.5 W and a light efficiency of 50 lm/W are available already at the present time. It has to be assumed that from the year 2008 white LEDs with a power loss of 5 W per LED and a light efficiency of 50 lm/W or alternatively with a power loss of 2.5 W and a light efficiency of 70 lm/W will be commercially available.

As can be seen from the table above, for the substitution of a conventional 75 W filament lamp with about 900 lm luminous flux at least four, preferably six white LEDs with a light efficiency of 50 lm/W and a power of 2.5 W per LED should be interconnected, which then respectively results in a luminous flux of 500 lm or 750 lm.

FIG. 1 shows a first exemplary embodiment of the LED-illuminant according to the invention with four white LEDs 4.*i* with i=1, 2, 3 and 4. The depiction of the housing, the socket as well as the electrical circuit components for controlling the LEDs was set aside. The LED-illuminant comprises four angled supports 1.*i*, wherein a single support 1.*i* can be substructured in an angled support section 2.*i* and the rest of the support, which is support section 3.*i*. Such a support 1.*i* does not mandatory have to be fabricated by bending an even integrally formed original support, but can also be achieved by assembling two support sections 2.*i* and 3.*i* in an angle. In this case the both support sections 2.*i* and 3.*i* do not mandatory have to be fabricated by the same material. Preferably, the support 1.*i* comprises an angled cooling metal sheets of metal, in particular an angled aluminium metal sheets.

On the angled support section 2.*i* is mounted at least one LED 4.*i* with the associated circuit board (not shown). In relation to the length extension of the support 1.*i* the LED 4.*i* is mounted asymmetrically on the support 1.*i*. The circuit board does not have to be constricted to the angled support section 2.*i* but can also extend to the rest of the support 3.*i*. The support 1.*i* can also be part of the circuit board; in this case a circuit board layer, for example an aluminium oxide layer, takes over the function of the support. Preferably, the circuit board with the LED 4.*i* is respectively mounted on the support 1.*i*.

The support sections 3.*i* are respectively arranged in parallel to a common axis. Respectively two supports 1.*i* are arranged in parallel to each other with their support sections 3.*i*. The both supports 1.1 and 1.2, arranged in parallel, extend in one direction along the common axis while the other both supports 1.3 and 1.4, arranged in parallel to each other, extend in the corresponding opposite directed direction along the common axis. The interior angle between the angled support section 2.*i* and the associated support section 3.*i* corresponds to the half of the exterior angle between two angled support sections 2.*i* of two parallel supports 1.*i*.

As further shown in FIG. 1, the four supports 1.*i* with respectively one LED 4.*i* mounted thereon are arranged such that the LEDs 4.*i* on the angled support sections 2.*i* are located in solid angles which correspond substantially to the solid angles of a polyhedron, here a tetrahedron. This allows an omni-directional emission characteristics. For the approximate formation of a spot light the LEDs 4.*i* should be brought together on the angled support sections 2.*i* preferably close. Therefore, in FIG. 1 not only the solid angles of the angled support sections 2.*i* correspond to those of a tetrahedron but also the angled support surfaces 2.*i* are forming together substantially a tetrahedron. For comparison an ideal tetrahedron is shown in FIG. 2.

In order to arrange the angled support sections in shape of a tetrahedron, the angled support sections 2.*i* narrow towards their end in the shape of a substantially isosceles trapezoid. Alternatively, the angled support section 2.*i* could also be respectively realized in the form of an equilateral triangle.

During operation of the LED-illuminant, the heat loss of the single LED 4.*i* can in a sufficient manner be dissipated starting from the angled support section 2.*i* over the support sections 3.*i*. This is due to the use of angled supports 1.*i* for each LED 4.*i* besides the surface 2.*i* on which the respective LED 4.*i* is arranged on, namely a further cooling surface in the shape of an support section 3.*i* is provided. Thereby the surface, which is available for heat dissipation, is substantially enlarged such that the thermal resistance decreases.

FIG. 3 shows the radiation diagram of the LED-illuminant shown in FIG. 1. In the radiation diagram the individual radiation components 5.*i* of the LEDs 4.*i* are shown, which have been projected on a common plane. Each LED 4.*i* respectively provides an emission angle of 120°. The total radiation results from the superposition of the single radiation components 5.*i*. As can be seen from FIG. 3, the LED-illuminant according to FIG. 1 pro-vides an omni-directional emission characteristics.

In FIG. 4 a second exemplary embodiment of the LED-illuminant according to the invention is shown. Those parts of both illuminants in FIG. 1 and FIG. 4 provided with the same reference numbers correspond to each other. In contrast to the illuminant shown in FIG. 1, the supports 1.*i*, in particular the support sections 3.*i* of the illuminant of FIG. 4 do provide holes 6. Preferably, the holes are generated by punching of a cooling metal sheet. Due to the holes 6 in the support 1.*i*, the surface, which is available for heat dissipation, is enlarged such that the thermal resistance decreases.

FIG. 5 shows a third exemplary embodiment of the LED-illuminant according to the invention. Those parts of the both illuminants in FIG. 1 and FIG. 5 provided with the same reference numbers correspond to each other. In contrast to the illuminant shown in FIG. 1, the support sections 3.*i* of the illuminant shown in FIG. 5 are curved around the common axis, such that the support sections 3.*i* substantially form a tubular shaped cooling body. Thereby, the surface which is available for the heat dissipation is enlarged, because the opposing side surfaces of the support sections 3.1 and 3.2 or respectively 3.3 and 3.4 are used for the thermal coupling of the cooling body to the environment of the cooling body. The thermal resistance can be further reduced if the support 1.*i* is mounted on a bar extrusion profile, in particular on an aluminium bar extrusion profile, such that the channel, which is formed by the support sections 3.*i* is filled with the bar extrusion profile.

In FIG. 6 a fourth exemplary embodiment of the LED-illuminant according to the invention is shown. Those parts of the both illuminants in FIG. 1 and FIG. 6 with the same reference numbers correspond to each other. In contrast to the exemplary embodiment according to FIG. 1, six white LEDs are interconnected in the exemplary embodiment as shown in FIG. 6, such that a higher luminous flux results in comparison to the exemplary embodiment shown in FIG. 1 with four white LEDs.

As can be seen from the preceding table, a luminous flux of 750 Im can be achieved by interconnecting six white LEDs with a light efficiency of 50 Im/W and a power of 2.5 W per LED. As can be seen in FIG. 6, the support sections 3.*i* are arranged in parallel to a common axis. Respectively, three supports 1.*i*, namely the supports 1.1, 1.2 and 1.3 or respectively 1.4, 1.5 and 1.6 are facing each other with their respective support sections 3.*i*. The three supports 1.1, 1.2 and 1.3 extend in one direction along a common axis, while the supports 1.4, 1.5 and 1.6 extend in the opposite direction thereof along the common axis.

The supports 1.*i* with respectively an LED 4.*i* arranged thereon are arranged such that the solid angles of the angled support sections 2.*i* substantially correspond to six elected solid angles of a cubic octahedron with in total 14 side surfaces and thereby 14 solid angles. In FIG. 7 an ideal cubic octahedron is shown for comparison. Thereby, the shape of the surfaces of the angled support sections 2.*i* do not have to correspond to the shape of the surfaces of the side surfaces of a cubic octahedron. Thus, the angled support sections 2.*i* shown in FIG. 6 respectively provide the surface of a triangle, while the cubic octahedron as shown in FIG. 7 not only comprises triangles but also squares as side surfaces.

Similar to the exemplary embodiment shown in FIG. 5 with curved support sections 3.*i*, the opposing side surfaces of the support sections 3.1, 3.2 and 3.3 or respectively 3.4, 3.5 and 3.6 are standing free such that the surfaces can be used for the thermal coupling of the cooling body to the environment of the cooling body. Further, the supports 1.*i* can—as is the case in the exemplary embodiment of FIG. 5—also be mounted on a bar extrusion profile such that the thermal coupling of the facing side surfaces of the support sections 3.*i* to the environment is further increased.

FIG. 8 shows the radiation diagram of the LED-illuminant shown in FIG. 6. In the radiation diagram the individual radiation components 5.*i* of the LEDs 4.*i* are shown, which have been projected into a common plane. Each LED 4.*i* respectively provides an emission angle of 120°. The total radiation results from the superposition of the individual radiation components 5.*i*. As can be seen from FIG. 8, the LED-illuminant according to FIG. 6 shows an omni-directional emission characteristics. Due to the use of six LEDs 4.*i* and thereby the larger overlapping of the coned shaped solid angles of the single LEDs, the angle dependency of the radiation is lower compared with the radiation diagram with four LEDs 4.*i* shown in FIG. 3.

In FIG. 9 a completed LED-illuminant is schematically shown with a socket 6, a transformer housing 7 and an optional housing 8 made from glass or plastic. The LED-illuminant further comprises a support arrangement equipped with LED-elements, for example the support arrangement according to FIG. 1. Alternatively, the support arrangements of FIGS. 4, 5 and 6 could also be comprised. The socket 6 as shown in FIG. 9 is the socket of a conventional 230 V lamp or 12 V lamp; for example a socket of type E14, E27, G9, B15d or R7s in the case of a high-voltage socket or a socket of the type Gy6.35, Gx5.3 in the case of a low-voltage socket. Furthermore, the socket can be double-ended instead of single-ended. The transformer housing 7 surrounds electric circuit components (not visible), which are used for controlling the LEDs. Preferably, the circuit components in AC voltage operation comprise a transformer, which reduces the voltage at the socket (for example 230 V or 12 V) to a lower value. Furthermore, in the AC voltage operation, a rectifier is provided. Since the LEDs are operated with a constant current, the electric circuit components preferably comprise circuit means (for example a multiplier or a JFET current source) for operating the LEDs with constant current. The electric circuit components are followed by the support arrangement, whose LEDs are controlled by the electric circuit components. However, the electric circuit components can also be mounted in part or even completely onto the support arrangement.

Optionally, a transparent glass or plastic housing 8 is provided, which surrounds the support arrangement and, for example, is configured tubular shaped. Thereby, the housing can be fabricated from clear or satin glass or respectively plastic.

An illuminant as shown in FIG. 9 is suitable as replacement for conventional illuminants, in particular for conventional filament lamps or halide lamps.

The invention claimed is:

1. LED-illuminant, comprising a plurality of supports each including an angled portion, wherein the angled portions are arranged adjacent one another to substantially correspond to angled surfaces of a polyhedron; and a plurality of LED-elements arranged on the angled portions wherein the heat generated by the individual LED-elements is respectively dissipated from the angled portion to the rest of the support, wherein at least two of the supports are arranged parallel to a common axis, and wherein a first group of supports extends in one direction along the common axis, while a second group of supports extends in an opposite direction thereof along the common axis.

2. The LED-illuminant according to claim 1, wherein for at least two supports, whose angled support sections are adjacent, the interior angle between the angled support section and the rest of the support corresponds to the half of the exterior angle between the adjacent angled support sections of said supports.

3. The LED-illuminant according to claim 1, wherein the supports are identical.

4. The LED-illuminant according to claim 1, wherein the polyhedron is a tetrahedron and further wherein the LED-illuminant comprises four angled support sections, wherein the solid angles of the four angled support sections substantially correspond to the four solid angles of the tetrahedron.

5. The LED-illuminant according to claim 1, wherein the polyhedron is a cubic octahedron and the LED comprises six angled support sections, wherein the solid angles of the six angled support sections substantially correspond to six different solid angles of the cubic octahedron.

6. The LED-illuminant according to claim 1, wherein the supports are angled metal sheets.

7. The LED-illuminant according to claim 1, wherein the supports form a channel along the common axis.

8. The LED-illuminant according to claim 1, wherein the supports are curved around the common axis.

9. The LED-illuminant according to claim 1, wherein the supports are mounted on a bar extrusion profile.

10. The LED-illuminant according to claim 1, wherein the supports provide holes for increasing the surface.

11. The LED-illuminant according to claim 1, wherein the plurality of LED-elements respectively emit white light.

12. The LED-illuminant according to claim 1, wherein the LED-illuminant is a lamp.

13. The LED-illuminant according to claim 1, wherein at least one LED-element is arranged on each angled support section.

14. The LED-illuminant according to claim 13, wherein a single LED element is arranged on each angled support section.

15. The LED-illuminant according to claim 1, wherein the angled support sections substantially correspond to different side surfaced of a polyhedron or to parts of said surfaces.

16. The LED-illuminant according to claim 15, wherein the angled support sections substantially form a polyhedron.

17. The LED-illuminant according to claim 1, wherein the plurality of LED-elements includes at least four LED-elements.

18. The LED-illuminant according to claim 17, wherein the plurality of LED-elements includes four, six, or eight LED-elements.

19. The LED-illuminant according to claim 1, wherein one or several electrical circuit components for operating the LED-elements are arranged at one end of a support arrangement formed by the supports.

20. The LED-illuminant according to claim 19, wherein a transformer is arranged at one end of the support arrangement formed by the supports.

21. The LED-illuminant according to claim 1, wherein the LED-illuminant comprises a plug configured to be received in conventional 230 V or 12 V lamp sockets.

22. A method of using the LED-illuminant according to claim 21, the method comprising:

using the LED-illuminant as a replacement for a filament or halide lamp.

23. A method for the fabrication of an LED-illuminant, the method comprising:

providing a plurality of supports, which are respectively angled, and on whose angled support sections a plurality of LED-elements is respectively arranged on, wherein during the operation of the LED-illuminant the heat of the individual LED-elements is respectively dissipated starting from the angled support section via the rest of the support; and arranging the supports such that the angled support sections are adjacent and the solid angles of the surfaces of the angled support sections substantially correspond to different solid angles of a polyhedron, wherein at least two of the supports are arranged in parallel to a common axis and a first group of supports extends in one direction along the common axis, while a second group of supports extends in the opposite direction thereof along the common axis.

* * * * *

UNITED STATES PATENT AND TRADEMARK OFFICE

CERTIFICATE OF CORRECTION

PATENT NO. : 8,382,320 B2
APPLICATION NO. : 12/519427
DATED : February 26, 2013
INVENTOR(S) : Christoph Kuegler It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 759 days.

Signed and Sealed this
First Day of September, 2015

Michelle K. Lee

Michelle K. Lee
*Director of the United States Patent and Trademark Office*